US006822569B1

(12) United States Patent
Bellum et al.

(10) Patent No.: US 6,822,569 B1
(45) Date of Patent: Nov. 23, 2004

(54) INSERTABLE ELECTRONIC ARTICLE SURVEILLANCE LABEL

(75) Inventors: Karen Bellum, Boca Raton, FL (US); Patrick Hemery, Fontenay aux Roses (FR); John Flanderhijn, CG Zwolle (NL); Richard Tellshow, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 184 days.

(21) Appl. No.: 10/161,406

(22) Filed: May 31, 2002

(51) Int. Cl.[7] ..... G08B 13/14
(52) U.S. Cl. ..... 340/572.1; 340/572.8; 235/449
(58) Field of Search ..... 340/572.1–572.9; 235/449, 435, 487

(56) References Cited

U.S. PATENT DOCUMENTS 4,254,868 A * 3/1981 Humble et al. ..... 206/484
4,317,990 A * 3/1982 Zmokly et al. ..... 235/494
4,510,489 A * 4/1985 Anderson, III et al. .. 340/572.1
5,218,342 A * 6/1993 McCrackin ..... 340/572.8
5,385,231 A * 1/1995 Nowotny ..... 206/309
5,554,974 A * 9/1996 Brady et al. ..... 340/572.6
5,825,298 A * 10/1998 Walter ..... 340/825.49
6,222,453 B1 4/2001 Joyce ..... 340/572.8
6,636,769 B2 * 10/2003 Govari et al. ..... 607/60

* cited by examiner

*Primary Examiner*—Benjamin C. Lee
*Assistant Examiner*—Phung Nguyen

(57) ABSTRACT

An electronic article surveillance (EAS) label adapted for insertion into the packaging of various products, such as a compact disc jewel cases. The label is formed with a point at one end, and is sufficiently rigid to puncture plastic wrap that may encase the product. The maximum label dimensions are preferably maintained small enough to be inserted into one of the slots in a jewel case.

10 Claims, 4 Drawing Sheets

INSERTABLE ELECTRONIC ARTICLE SURVEILLANCE LABEL

CROSS REFERENCES TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

This invention relates to electronic article surveillance (EAS) labels, and more particularly to an EAS label that facilitates insertion into products and product packaging.

2. Description of the Related Art

Electronic article surveillance (EAS) systems are well known in the art, and are typically used for article identification and/or detection. A primary application is theft deterrence or to prevent the unauthorized removal of articles from a controlled area. The EAS systems typically utilize interrogation zones that must be traversed to remove articles from the controlled area. An EAS detectable label is attached to every article that is to be protected. When an unauthorized article removal is attempted, the EAS system detects the label as the article traverses the interrogation zone. The EAS system responds to the detected label with an alarm condition and a preselected action is taken.

If the article removal is authorized, the label can be removed from the article, deactivated so it will no longer be detectable by the EAS system, or diverted around the interrogation zone.

There are several types of EAS labels known in the art which are utilized with different types of EAS systems. One of the primary EAS systems uses a magnetic field in the interrogation zone, and a corresponding magnetomechanical or acoustomagnetic label that is detectable when it is placed within the magnetic field in the interrogation zone. The label includes a magnetic resonator that mechanically vibrates at a predetermined frequency when placed within the interrogation magnetic field. A magnetic biasing material is placed in close proximity to the resonator to magnetically bias the resonator to vibrate at the predetermined frequency. The EAS system receiver detects the predetermined frequency of vibration from the label. A label and EAS system of this type are taught in U.S. Pat. No. 4,510,489 to Anderson, III et al.

FIG. 1 illustrates a magnetomechanical EAS label 1 that is similar to the EAS labels sold by the assignee of this application under the brand name "ULTRA●MAX®"; such labels provide excellent performance and are in widespread use for theft deterrence. EAS label 1 includes a housing 2 that has a cavity 4 and a flange 6. Housing 2 is at least semi-rigid and can be rigid, and is made of plastic. One or more, magnetic elements or resonators 8, which mechanically vibrates at a predetermined frequency in response to an interrogation magnetic field, as discussed above, is positioned within in cavity 4. Lid 10 is positioned on flange 6 and sealed thereto. Biasing element 12, which is a semi-hard or hard magnetic element that biases magnetic resonator 8 is placed upon lid 10. Adhesive film 14 is then positioned on top of lid 10 and bias 12, and is bonded to flange 6. Several other types of EAS systems are currently in use including RF, microwave, and harmonic systems, but will not be individually described as the magnetomechanical EAS label discussion herein applies equally to other technologies.

Once the EAS label is manufactured, it must be attached to products to be protected. Attachment can be external attachment or internal to a product or product packaging. To reduce the chances of unauthorized label removal, internal label attachment is preferred. Insertable label housings are known, which are small plastic housings into which an EAS label is placed. The housing has a point at one end, and is inserted into objects such as paperboard or cardboard boxes by either manual insertion or through the use of an insertion tool. The housing is used because EAS labels are generally not sufficiently rigid to be pushed into such packages, and are not conventionally manufactured with a point at one end. A significant problem is that the insertable label housing must be large enough to hold an EAS label, and therefore are fairly large in relation to certain products. The size of the label housing presents a problem for internal EAS labeling of certain products, for example music, video, and computer compact discs (CDs). CDs are sold in what are known as "jewel cases", which are rectangular shaped plastic cases that hold the CD, and possibly written material. The jewel cases are typically sealed in plastic wrap. To insert an EAS label into the jewel case, the plastic wrap must first be penetrated. Second, the label must be sized to fit into the plastic case. The label housing is rigid enough, but too big to fit within the jewel case. An EAS label is needed, which can be easily inserted into the packaging of products.

BRIEF SUMMARY OF THE INVENTION

In accordance with the present invention, an insertable electronic article surveillance (EAS) label is provided. The label is of the type having a housing with a cavity; a magnetic resonator disposed in the cavity; a first lid covering the cavity and connected to the housing; a magnetic bias disposed over the cavity and disposed on the first lid; a second lid covering the bias and connected to the first lid. The improvement is characterized by a label member having a relatively narrow overall width dimension, the label is connected to a substrate adapted to have about the same overall width as the label member and having a point at one end, and being relatively rigid for insertion through an exterior layer of plastic wrapping material and into a product packaging, or into a product directly.

The insertable label may alternately be characterized by the housing having a relatively narrow overall width dimension and having a point at one end, the housing being relatively rigid for insertion through an exterior layer of plastic wrapping material and into a product packaging, or into a product directly.

Either of the embodiments above may further be characterized by the insertable label having an overall width dimension of less than about 10 mm. And, the insertable label can be less than about 2.2 mm in a thickness dimension. The housing may have a flange disposed around the perimeter of the cavity where the first lid is connected, and having a relatively narrow width dimension as measured along two sides of said label. The width dimension can be about 0.5 mm along each of the two sides.

Objectives, advantages, and applications of the present invention will be made apparent by the following detailed description of embodiments of the invention.

DETAILED DESCRIPTION OF THE INVENTION

Figure 1:
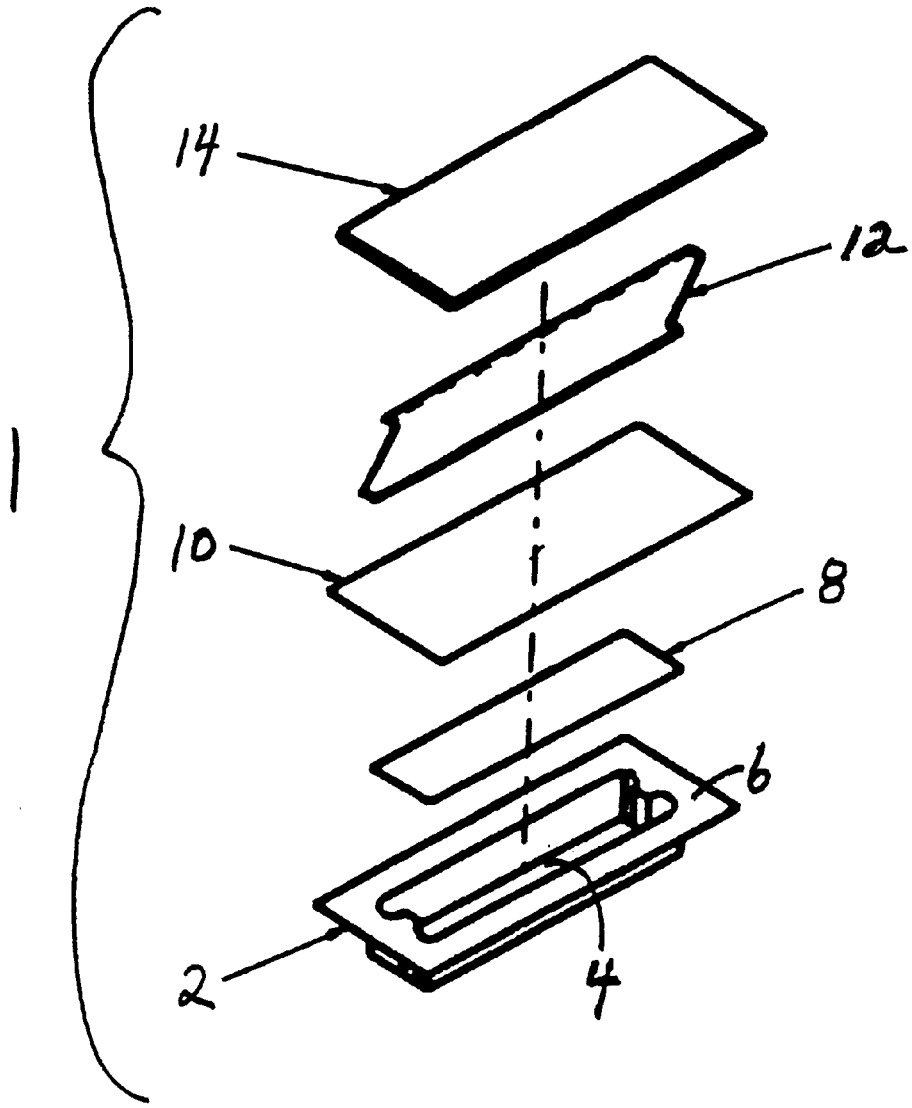
FIG. 1 PRIOR ART
FIG. 1 is an exploded perspective view of a prior art magnetomechanical/acoustomagnetic EAS label.
Figure 4:
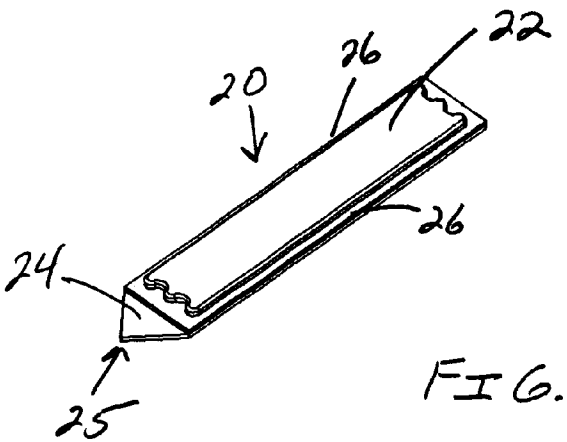
FIG. 4 is a top perspective view of that in FIG. 2.
Figure 5:
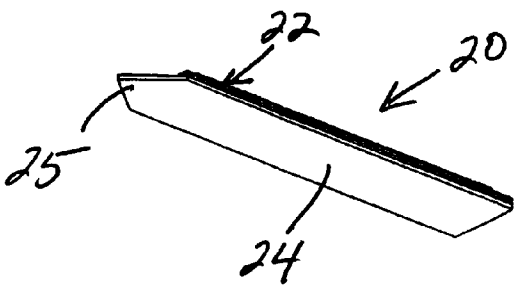
FIG. 5 is a bottom perspective view of that in FIG. 2.
Figure 2:
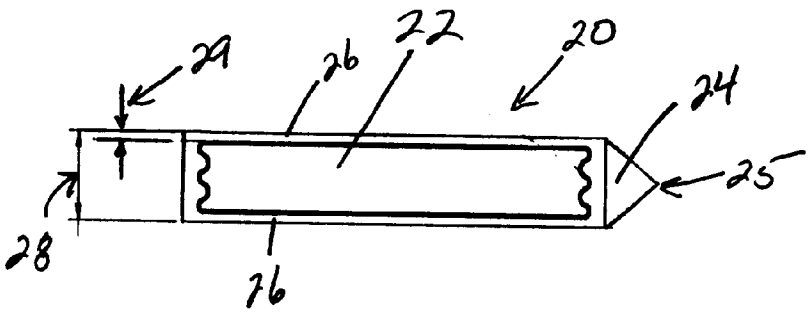
FIG. 2 is a top plan view one embodiment of the present invention.
Figure 6:
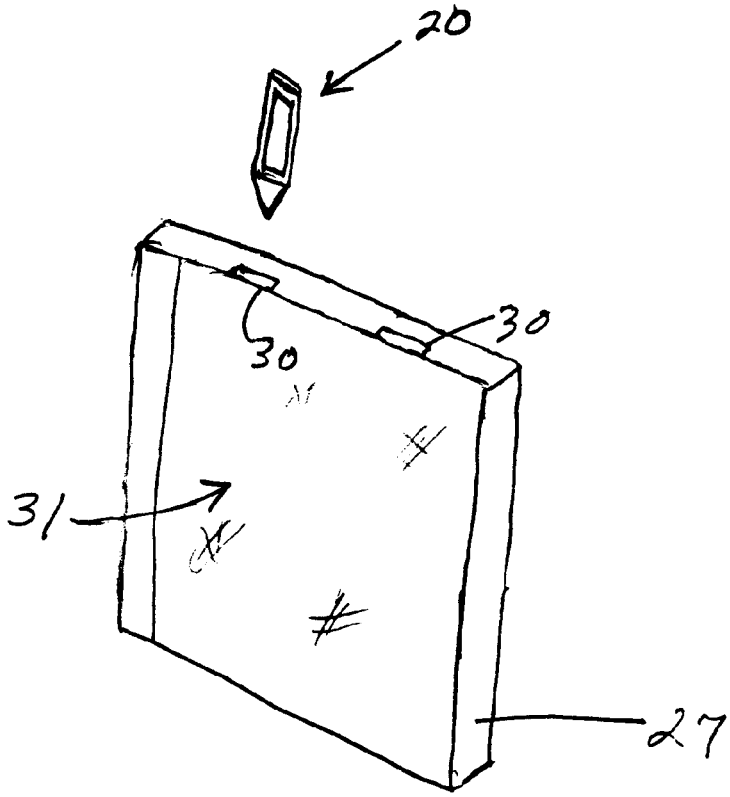
FIG. 6 is top perspective view of one use of the present invention.
Figure 9:
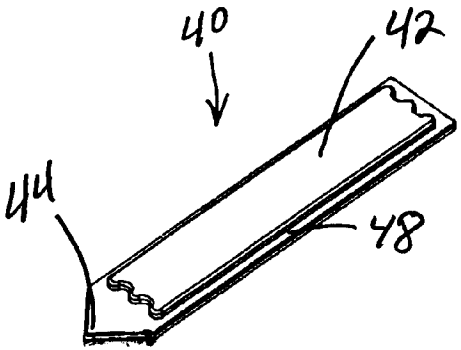
FIG. 9 is a top perspective view of that in FIG. 7.
Figure 10:
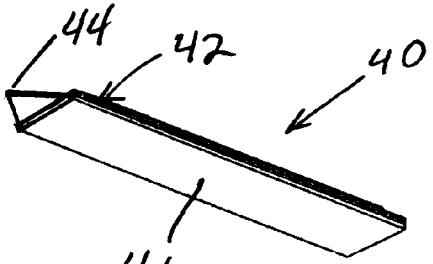
FIG. 10 is a bottom perspective view of that in FIG. 7.
Figure 7:
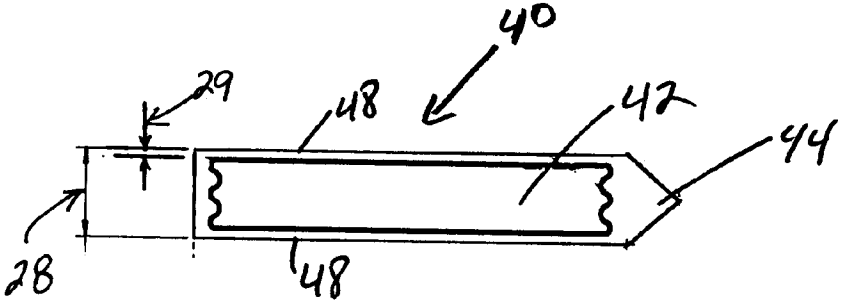
FIG. 7 is a top plan view of an alternate embodiment of the present invention.
Figure 8:
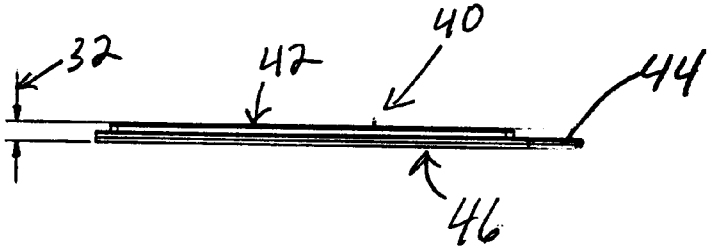
FIG. 8 is a side elevation view of that in FIG. 7.

Referring to FIGS. 2 through 5, an EAS label 20 in accordance with the present invention for insertion into products is illustrated. Insertable EAS label 20 includes EAS label member 22 connected to a relatively rigid substrate 24 that has a point 25 at one end. EAS label member 22 is a conventional EAS label 1, as shown in FIG. 1, with the long sides 26 of flange 6 trimmed to reduce the overall width 28 of label 20 to a maximum of about 9.75 mm. This dimension is determined by the width of the slots 30, which are presently built into a standard jewel case 27, as shown in FIG. 6. The dimensions of slots 30 are presently about 10 mm wide by 2.2 mm in height. The width of label 20 should be sufficiently narrow to fit within the 10 mm width of the slot 30 in jewel case 27. The width 29 of side flanges 26 should be about 0.5 mm for each side of label 20. Flanges 26 could be thinner or thicker as long as the overall width dimension 28 is sufficiently small so that label 20 is insertable into the intended product.

Figure 3:
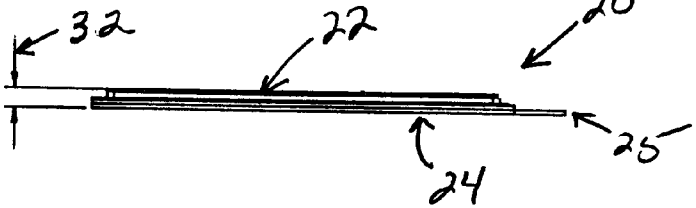
FIG. 3 is a side elevation view of that in FIG. 2.

Referring also to FIG. 6, substrate 24 is preferably made of a relatively rigid material, such as plastic, adapted to have a point 25 at one end. EAS label member 22 can be bonded to substrate 24 in any suitable manner, as known in the art. Substrate 24 must be sufficiently rigid to enable point 25 of EAS label member 22 to puncture the plastic wrap 31, which jewel case 27 is encased. Label 20 must also be thin enough to fit into the available slot 30 height within the jewel case 27. The overall thickness 32 of label 20 should be about 2.08 mm, as shown in FIG. 3 to enable insertion through the 2.2 mm height of slot 30.

Referring to FIGS. 7 through 10, an alternate embodiment of the EAS insertable label is illustrated at 40. Label 40 has the same dimensions 28, 29, and 32 as label 20 described above, but is constructed differently. Referring back to FIG. 1, housing 2 is formed elongated with a point at one end, to form insertable label housing member 42 having a point 44 at one end, as shown in FIGS. 7–10. Label 40 includes cover member 46 and is constructed in an analogous manner to label 1 illustrated in FIG. 1. The side flanges 48 of label 40 are trimmed to the same dimensions 29 as label 20 above, or nominally about 0.5 mm, resulting in an overall label width 28 of about 9.75 mm. Housing member 42 must be made of a rigid material, such as plastic or other material that is strong enough to puncture plastic wrap 31 of jewel case 27, as shown in FIG. 6, while maintaining the thickness dimension 32 to less than about 2.2 mm. Suitable materials for housing member 42 are polystyrene or polyethylene, but other plastic or non-plastic material can be used. Label 40 is inserted into a jewel case 27, analogously to label 20, as illustrated in FIG. 6.

Jewel case 27 is designed to hold a CD, and is used herein as an example of one product and product packaging. Labels 20 and 40 are not limited to use within a jewel case and can be adapted for use in any number of products and product packaging such, as but not limited to, perfume, cosmetics, computer products, electronics, tools, sporting goods, automotive supplies, kitchen appliances, and other products.

It is to be understood that variations and modifications of the present invention can be made without departing from the scope of the invention. For example, label 20 and label 40 can be made in a completely different manner, such as injection molding, resulting in a design, which forms a cavity for holding a resonator, and having the housing and lid formed together without forming flanges 26 and 48. It is also to be understood that the scope of the invention is not to be interpreted as limited to the specific embodiments disclosed herein, but only in accordance with the appended claims when read in light of the forgoing disclosure.

What is claimed is:

1. An insertable label detectable by an electronic article surveillance system, comprising:

a label member having a relatively narrow overall width dimension and comprising:

a housing with a cavity;

a magnetic resonator disposed in said cavity;

a first lid covering said cavity and connected to said housing;

a magnetic bias disposed over said cavity and disposed on said first lid; and a second lid covering said bias and connected to said first lid;

wherein said label member is connected to a substrate, said substrate being adapted to have about the same overall width as said label member and having a point as one end of said label and being relatively rigid.

2. The insertable label of claim 1 wherein said insertable label having an overall width dimension of less than about 10 mm.

3. The label of claim 2 wherein said insertable label having a thickness dimension of less than about 2.2 mm.

4. The label of claim 3 wherein said housing having a flange disposed around a perimeter of said cavity, said first lid connected to said flange, and said flange having a relatively narrow flange width dimension as measured along two sides of said label.

5. The label of claim 4 wherein said flange width dimension being about 0.5 mm along each of said two sides.

6. An insertable label detectable by an electronic article surveillance system, the label of the type having a housing with a cavity; a magnetic resonator disposed in said cavity; a first lid covering said cavity and connected to said housing; a magnetic bias disposed over said cavity and disposed on said first lid; a second lid covering said bias and connected to said first lid;

said insertable label characterized by said housing having a relatively narrow overall width dimension and having a point as one end of said label, said housing being relatively rigid for insertion through an exterior layer of plastic wrapping material and into a product packaging.

7. The insertable label of claim 6 wherein said insertable label having an overall width dimension of less than about 10 mm.

8. The label of claim 7 wherein said insertable label having a thickness dimension of less than about 2.2 mm.

9. The label of claim 8 wherein said housing having a flange disposed around a perimeter of said cavity, said lid connected to said flange, and said flange having a relatively narrow flange width dimension as measured along two sides of said label.

10. The label of claim 9 wherein said flange width dimension being about 0.5 mm along each of said two sides.

* * * * *